United States Patent [19]

Voorhis et al.

[11] Patent Number: 4,796,436

[45] Date of Patent: Jan. 10, 1989

[54] HEAT PUMP CHARGING

[75] Inventors: Roger J. Voorhis, Liverpool; John M. Palmer, Syracuse, both of N.Y.

[73] Assignee: Carrier Corporation, Syracuse, N.Y.

[21] Appl. No.: 939,825

[22] Filed: Dec. 9, 1986

[51] Int. Cl.[4] ..... F25B 45/00

[52] U.S. Cl. ..... 62/77; 62/149

[58] Field of Search ..... 62/149, 174, 292, 77, 62/212

[56] References Cited

U.S. PATENT DOCUMENTS 4,100,306 8/1978 Saunders ..... 62/149

4,484,452 11/1984 Houser, Jr. ..... 62/149 X 4,523,435 6/1985 Lord ..... 62/212

*Primary Examiner*—William E. Wayner

*Attorney, Agent, or Firm*—Dana F. Bigelow

[57] ABSTRACT

A method of controllably charging a heat pump system with refrigerant until adequately charged for the cooling mode of operation, including checking the outdoor ambient temperature, injecting sufficient refrigerant to sustain safe compressor operation, operating the compressor at higher or lower rates depending upon the detected ambient temperature level and determining when to halt charging by monitoring indoor coil inlet and suction temperature differences in the heat pump system.

2 Claims, 3 Drawing Sheets

HEAT PUMP CHARGING

BACKGROUND OF THE INVENTION

The invention herein is directed toward the field of heat pump systems and particularly toward the field of charging techniques for the closed refrigerant loop of a heat pump system, especially one active in the cooling mode of operation.

Heat pump systems of many kinds are well known. One kind in common use employs indoor and outdoor coils connected by reversible expansion valves which operate in one direction during the heating mode of the heat pump system, and in the other direction during the cooling mode of operation. The heat pump systems typically additionally include a compressor to drive refrigerant through the respective coils one way or the other. Often the compressor itself is not reversible, so a four-way valve is employed to switch the compressor output from one coil to the other. A typical system further includes an accumulator at the input of the compressor, which generally acts to collect excess liquid refrigerant from refrigerant gas just before entry to the compressor.

As suggested, the compressor acts upon refrigerant gas. At the output of one of the coils, i.e. the condenser coil, the refrigerant will be in liquid phase because of the loss of heat from the refrigerant in the condenser. During the cooling mode of operation, the outdoor coil acts as the condensing coil.

It is thus addressed herein how best controllably to charge heat pump systems with refrigerant fluid during servicing in particular while the heat pump is in its cooling mode. More specifically, it is desired to prevent overcharging split system variable capacity heat pumps, in which one coil is outdoors and the other is indoors, during charging operation in the cooling operational mode of the heat pump system. Overcharging typically occurs in the field during charging operation by inexperienced field personnel conducting charging operation manually.

Once a heat pump is overcharged, liquid refrigerant may be injected into the compressor possibly causing it to fail. Additionally, complicated temperature and pressure corrections may have to be made as a result of overcharging, which require specialized equipment and consume inordinate amounts of time and other resources to perform.

SUMMARY OF THE INVENTION

According to the invention herein, charging of the heat pump system with refrigerant during the cooling mode is accomplished by performing the following steps. These include turning on both the indoor and the outdoor fans of the heat pump system, connecting an input refrigerant container which is brought to the site by service personnel, to a Schrader valve of the heat pump system, then introducing sufficient amounts of refrigerant to operate the compressor, checking the outdoor and indoor ambient temperatures, and monitoring temperature at the outlet of the indoor coil.

If either of the ambient temperatures exceeds a predetermined ambient threshold level, such as for example 60° Fahrenheit, the compressor driving refrigerant through the closed refrigerant loop of the heat pump system is operated at full speed. Then, if the difference between the, refrigerant temperature at the inlet of the outdoor coil and the refrigerant temperature at the output of the outdoor coil in successive time periods does not remain greater then a selected difference threshold such as for example two (2) degrees Fahrenheit, charging is discontinued. If the outdoor coil inlet ambient temperature drops below the indicated ambient threshold, the compressor is operated at a lower selected level, and charging of the refrigerant loop continues until the temperature difference between outdoor ambient and coil output drops below a scheduled level.

DESCRIPTION OF THE PREFERRED EMBODIMENT

Figure 1:
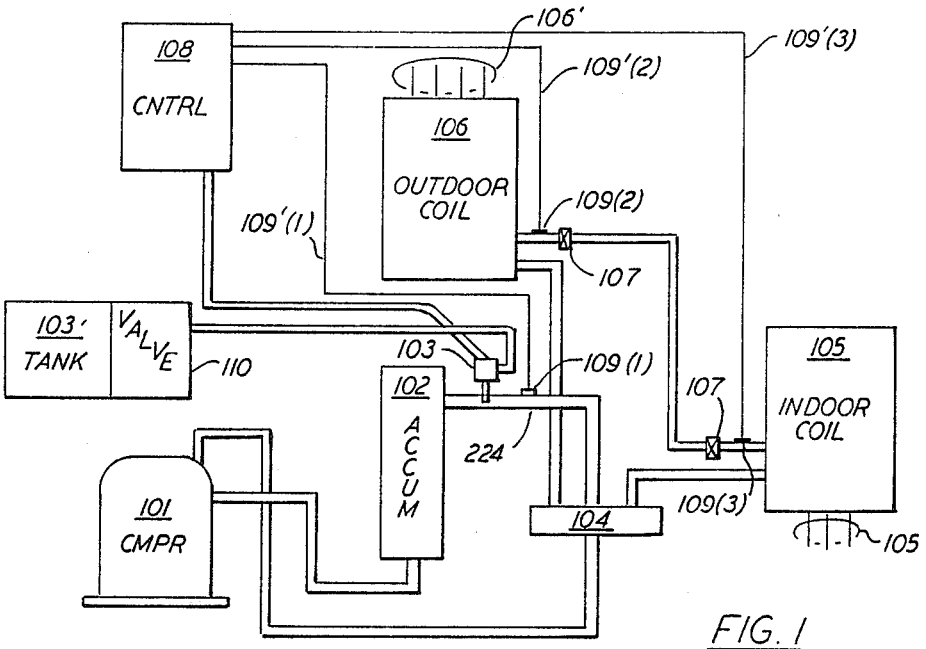
FIG. 1 shows the schematic of a preferred version of the heat pump system, in particular a split system effective for permitting operation according to the invention herein.

FIG. 1 in particular shows a heat pump arrangement or system 13 which is operable according to the invention herein. In particular, system 13 includes a compressor 101 for compressing refrigerant gas and effectively driving it through the closed loop refrigerant portion of heat pump system 13.

More specifically, compressor 101 receives refrigerant from accumulator 102, which collects varying amounts of refrigerant, depending upon whether the heat pump system is operating in the cooling or hating mode of operation.

New refrigerant is injected through charging solenoid valve 103 and a Schrader valve 110 for example which in turn connects to a refrigerant supply tank 103' which is brought to the scene of operations by service personnel.

Four-way valve 104, permits the heat pump arrangement 13 to be operated in heating or cooling modes by directing refrigerant either to indoor or outdoor coil, respectively 105 and 106. In particular, during the cooling mode, which is of particular interest herein, refrigerant is transported to the valve 104 from indoor coil 105 and passes toward accumulator 102. During the heating mode, refrigerant passes from outdoor coil 106 toward valve 104 and then toward accumulator 102.

Additionally expansion devices 107 and 107', a controller 108, refrigerant thermistor elements 109(3), and 109(2) effective respectively for sensing temperature at the indoor coil inlet and at the outdoor coil inlet 105 are additionally included in heat pump system 13.

Figure 2:
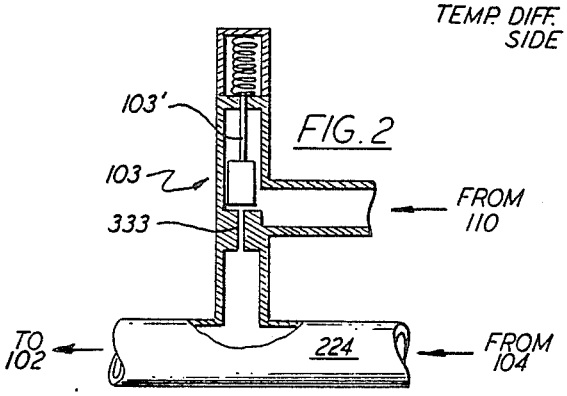
FIG. 2 shows a detail of a portion of the heat pump system in partial cross section, in particular showing a solenoid controlled charging valve employed during charging operation as discussed herein.

FIG. 2 shows in partial cross section details of the charging solenoid valve 103 and a portion of the tubing 224 between accumulator 102 and four-way valve 104. As can be seen, valve 103 includes solenoid 103' for controlling the flow from Schrader valve 110 through a narrowed passage 333 and into suction tube 224 during charging operation performed according to the scheme set forth in the flow chart of FIG. 3.

Figure 3:
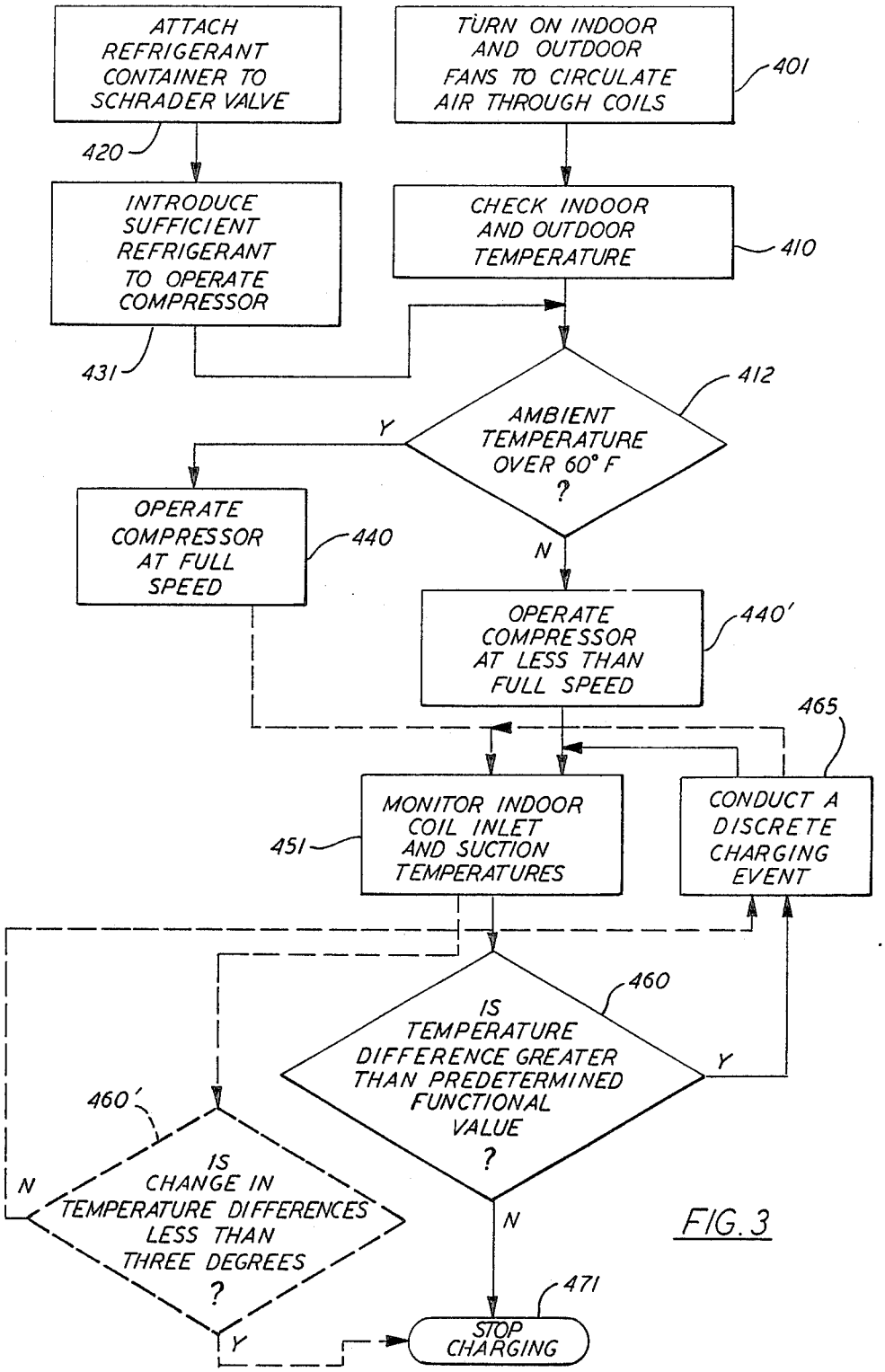
FIG. 3 is a flow chart illustrating operation according to the invention herein.

As suggested, FIG. 3 shows the steps involved in performing operation in accordance with the invention herein. In particular, block 401 indicates the first step of operation, namely turning on the indoor and outdoor fans respectively 105' and 106 to enable heat transfer with air through respective coils 105 and 106.

Next, both refrigerant temperatures are checked, i.e. detected and signalled electrically to controller 108, by respective thermistor elements 109(3) and 109(2) respectively at indoor and outdoor coils 105 and 106, as suggested at block 410. Controller 108 (which is preferably a microprocessor of suitable type) is effective for storing the respective values of indoor and outdoor ambient temperatures which have been checked.

Concurrently, or at least temporally proximate thereto, a selected bottle tank or container 103' filled with refrigerant and brought by service personnel is attached to the Schrader valve 10, according to block 420, and a predetermined amount of refrigerant is introduced into system 13, which is sufficient to permit safe compressor operation, as suggested at block 431.

Once compressor 101 begins operation, the heat pump system 13 is started and a predetermined period of time is marked by controller 108, permitting conditions in system 13 to stabilize. Concurrently therewith, the inlet temperature at outlet coil 106 is monitored with thermistor 109(2) and a signal indicative thereof is sent along line 109'(2) to controller 108. The system 13 operates with compressor 101 at full speed, as suggested by block 440, if the outdoor ambient temperature exceeds a predetermined threshold such as 60° F. for example. On the other hand, if the outdoor ambient temperature is below 60° F., or another selected value, threshold or set point, compressor operation is set to less than full speed as suggested in block 440'.

Next, the indoor coil inlet and suction temperatures respectively at sensors 109(3) and 109(1), between accumulator 102 and are monitored as suggested at block 451. Further, the difference between these values is determined, once or twice at least.

In the event that the monitored temperature differences diminish by more than a predetermined amount in successive microprocessor cycles of operation, as by 3° F. for example as suggested at block 460', according to one version of the invention (e.g. in the case of ambient temperature exceeding 60° F. for another selected value), charging events are conducted and continue. Charging can be considered to involve repeated charging pulses or events, each producing a discrete quantity of charging refrigerant.

Figure 4:
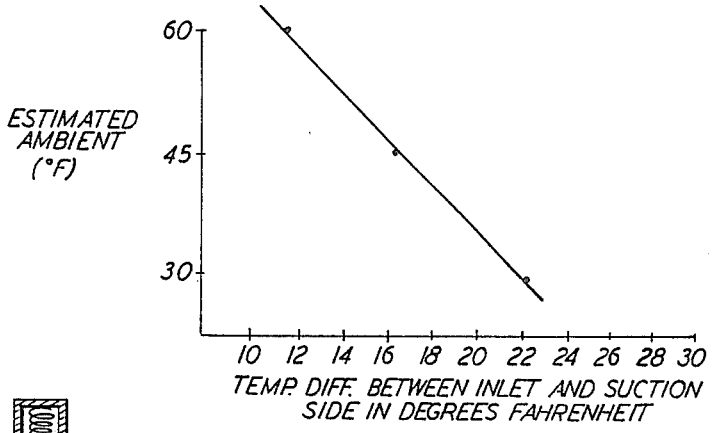
FIG. 4 is a graph of ambient temperature as a function of temperature differences between ambient inlet and refrigerant outlet sides of the outdoor coil.

According to another version of the invention, if, for instance, the monitored temperature difference falls below a predetermined functional value represented by the curve of FIG. 4 for a given ambient operating temperature (all these being below 60° F.), charging stops as well. Thus, the chart of FIG. 4 suggests a schedule of acceptable temperature differences at the input and output of outdoor coil 106 as a function of outdoor ambient temperature. However, as suggested at block 460 of FIG. 3, if the temperature difference is greater than a predetermined functional value, charging continues.

Figure 5:
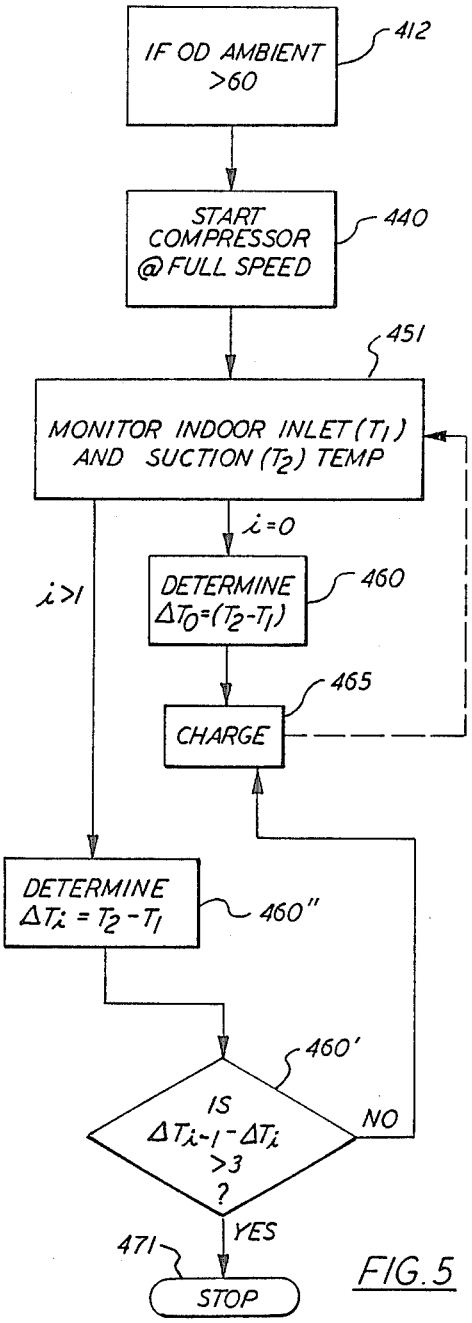
FIGS. 5 and 6 are additional flow charts illustrating operation of the invention according to first and second preferred versions thereof.
Figure 6:
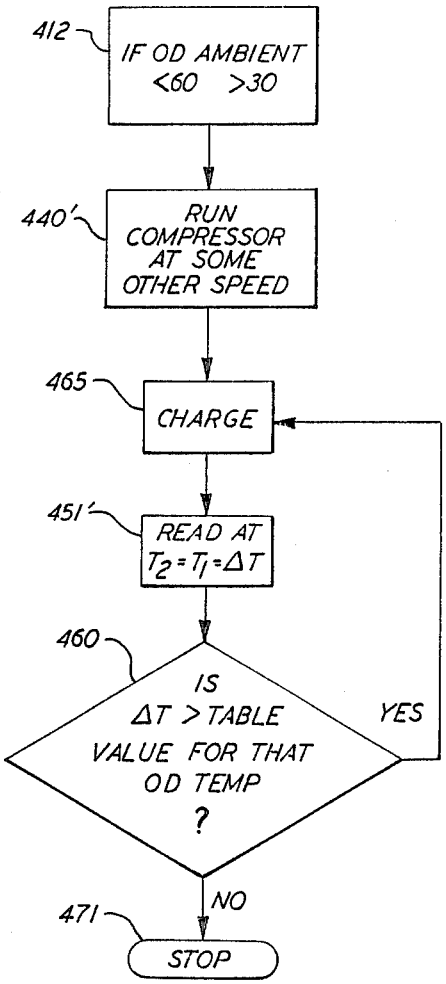

To further illustrate these two versions of the invention, see FIGS. 5 and 6. In particular, FIG. 5 shows the case in which the outdoor (OD) ambient temperature is greater than sixty (60) degrees, as represented by block 412. As already noted, block 440 urges starting the compressor 101 and operating it at full speed. Next, block 451 establishes the subsequent step of monitoring respective indoor inlet and suction temperatures, respectively "$T_1$" and "$T_2$" at respective sensors 109(3) and 109(1). Then, the difference between $T_2$ and $T_1$ is taken, as suggested at block 460 and then charging is conducted as per block 465. Thereafter, the procedure of block 451 is repeated and a new temperature difference delta $T_i$ is established as shown. Then, as per block 460', a difference of differences is taken to determine whether charging continues or stops.

FIG. 6 shows at block 412 and thereafter the charging procedure if the outdoor (OD) ambient temperature is between thirty (30) and sixty (60) degrees, that is less than sixty (60) and greater than (30) degrees, in which case per block 440', the compressor is run at some speed other than full speed, followed by charging as per block 465 and establishment of a temperature difference as per block 451'. Charging continues, if the temperature difference remains above tabulated values, indicted for example at FIG. 4. Otherwise, charging stops as indicated at oval 471.

While this invention has been described with reference to a particular embodiment disclosed herein, it is not confined to the details set forth herein and this application is intended to cover any modifications or changes as may come within the scope of the invention.

What is claimed is:

1. The method of charging a heat pump system including a compressor for circulating refrigerant between indoor and outdoor coils, comprising the steps of attaching a source of refrigerant to the heat pump system at a charging port, successively monitoring indoor coil inlet and suction temperatures, comparing said indoor coil inlet and suction temperatures successively to establish successive temperature differences therebetween, comparing said successive temperature differences and halting charging operation when said comparisons attain a predetermined threshold.

2. The method of claim 1, wherein said heat pump system is turned on after sufficient refrigerant is introduced to permit operation of the compressor.

* * * * *

UNITED STATES PATENT AND TRADEMARK OFFICE

CERTIFICATE OF CORRECTION

PATENT NO. : 4,796,436

DATED : January 10, 1989

INVENTOR(S) : DERRICK A. MARRIS; JOHN M. PALMER; ROGER J. VOORHIS; and JAMES D'AGOSTINO It is certified that error appears in the above-identified patent and that said Letters Patent are hereby corrected as shown below:

On the Title Page, Item [75],
The listed inventors should be corrected to read as follows:

Inventors: Roger J. Voorhis, Liverpool; John M. Palmer, Syracuse; Derrick A. Marris, Blossvale, all of N.Y.; James D'Agostino, Alpharetta, GA.

Signed and Sealed this

Fourth Day of April, 1989

*Attest:*

*Attesting Officer*

DONALD J. QUIGG

*Commissioner of Patents and Trademarks*